US009226565B1

(12) United States Patent
Martin

(10) Patent No.: US 9,226,565 B1
(45) Date of Patent: Jan. 5, 2016

(54) BACKPACK WITH A PILLOW AND EXTENDIBLE SLEEPING MAT

(71) Applicant: La Teene L. Martin, Mesquite, TX (US)

(72) Inventor: La Teene L. Martin, Mesquite, TX (US)

( * ) Notice: Subject to any disclaimer, the term of this patent is extended or adjusted under 35 U.S.C. 154(b) by 0 days.

(21) Appl. No.: 14/662,356

(22) Filed: Mar. 19, 2015

(51) Int. Cl.
*A45F 4/06* (2006.01)
*A45F 3/04* (2006.01)

(52) U.S. Cl.
CPC .... *A45F 4/06* (2013.01); *A45F 3/04* (2013.01)

(58) Field of Classification Search
CPC ..... A45F 4/02; A45F 4/06; A45F 4/042; A45F 4/08; A45F 2004/026
USPC ..... 224/576, 577, 153, 652, 653
See application file for complete search history.

(56) References Cited

U.S. PATENT DOCUMENTS 33,385 A * 10/1861 Frodsham ..... A45F 4/06 224/156
4,466,516 A * 8/1984 Sicoli ..... A47G 9/062 190/2
5,050,998 A * 9/1991 Wachtel ..... D06F 95/004 150/117
5,404,600 A * 4/1995 DeMars ..... A47G 9/086 5/413 R
5,544,792 A * 8/1996 Arnwine ..... A45C 7/0086 224/153
5,649,658 A * 7/1997 Hoffman ..... A45F 3/04 190/2
5,676,296 A * 10/1997 Masters ..... A45C 3/001 224/148.7
5,785,219 A * 7/1998 Kraft ..... A45F 4/02 2/66
6,393,638 B1 * 5/2002 MacColl ..... A45F 4/02 383/4
6,421,852 B1 * 7/2002 Shao ..... A63H 3/005 446/73
6,510,974 B2 * 1/2003 Willingham ..... A45C 7/0095 190/16
6,543,072 B2 * 4/2003 Hsu ..... A47G 9/086 5/413 R
6,952,845 B1 * 10/2005 Akkad ..... A45F 4/02 383/4
7,191,925 B2 * 3/2007 Aris ..... A45C 9/00 224/581
7,225,483 B1 * 6/2007 Remblad ..... A45F 4/06 383/4
7,516,500 B2 * 4/2009 Akkad ..... A45F 4/02 383/4
7,886,884 B2 * 2/2011 King ..... A45C 9/00 190/109
8,256,045 B2 * 9/2012 Cruz ..... A45C 9/00 383/4
8,490,230 B2 * 7/2013 Rovin ..... A47D 5/006 190/2
8,556,139 B2 * 10/2013 Almoumen ..... A45F 3/04 224/153
2002/0088830 A1 * 7/2002 Rose ..... A45C 9/00 224/153
2005/0177939 A1 * 8/2005 Botera ..... A47G 9/083 5/413 R
2005/0279794 A1 * 12/2005 Gerchen ..... A45F 3/042 224/576
2006/0277681 A1 * 12/2006 Mecheau ..... A47G 9/02 5/419
2009/0236379 A1 * 9/2009 Johnston ..... A45C 7/0077 224/155
2010/0140307 A1 * 6/2010 Almoumen ..... A45F 3/04 224/155
2011/0030140 A1 * 2/2011 Ruiz ..... A45F 4/06 5/419
2011/0309122 A1 * 12/2011 Sternlight ..... A45F 4/02 224/576
2012/0276803 A1 * 11/2012 Hernandez ..... A45F 3/04 446/75
2013/0001262 A1 * 1/2013 Razavi ..... A45F 4/06 224/156
2013/0228600 A1 * 9/2013 Teixeira ..... A47G 9/086 224/156
2014/0101848 A1 * 4/2014 Murphy ..... A47G 9/08 5/420
2014/0326558 A1 * 11/2014 Marti ..... A45C 9/00 190/2
2015/0041511 A1 * 2/2015 Powell ..... A45C 13/18 224/576

* cited by examiner

*Primary Examiner* — Justin Larson
(74) *Attorney, Agent, or Firm* — Crossley Patent Law

(57) ABSTRACT

A backpack with a pillow and extendible sleeping mat including a backpack portion having an upper compartment and a lower compartment therein accessible through a respective upper zipper and lower zipper; a foldable sleeping mat extendible from the lower compartment and having a first end attached to a top side of the backpack portion within the lower compartment, the sleeping mat including a plurality of a plurality of cushions conjoined in a longitudinal configuration and a folding crease disposed between each of the cushions; and a pillow disposed in the upper compartment. At least a rear side of the backpack portion is configured to resemble a body of an animal figure, while the auxiliary member is configured to resemble a head of the animal figure.

9 Claims, 3 Drawing Sheets

BACKPACK WITH A PILLOW AND EXTENDIBLE SLEEPING MAT

BACKGROUND OF THE INVENTION

Various types of portable blankets, mats, and sleeping bags, some of which include their own storage system are known. However, many of these known blankets are formed of separate pieces, which tend to increase the bulk and weight of the device, thereby negatively affecting its portability and tending to increase the possibility of misplaced pieces. What is needed is a backpack with a pillow and extendible sleeping mat including a backpack portion having an upper compartment and a lower compartment therein accessible through a respective upper zipper and lower zipper; a foldable sleeping mat extendible from the lower compartment and having a first end attached to a top side of the backpack portion within the lower compartment, the sleeping mat including a plurality of a plurality of cushions conjoined in a longitudinal configuration and a folding crease disposed between each of the cushions; and a pillow disposed in the upper compartment. At least a rear side of the backpack portion is configured to resemble a body of an animal figure, while the auxiliary member is configured to resemble a head of the animal figure.

FIELD OF THE INVENTION

The present invention relates to portable sleeping devices, and more particularly, to a backpack with a pillow and an extendible sleeping mat.

SUMMARY OF THE INVENTION

The general purpose of the present backpack with a pillow and extendible sleeping mat, described subsequently in greater detail, is to provide a backpack with a pillow and extendible sleeping mat which has many novel features that result in a backpack with a pillow and extendible sleeping mat which is not anticipated, rendered obvious, suggested, or even implied by prior art, either alone or in combination thereof.

To accomplish this, the present backpack with a pillow and extendible sleeping mat includes an expandable backpack portion having a continuous outer wall. The outer wall has a front side, a flat rear side, a top side, a bottom side, a right side, and a left side. An upper zipper is centrally disposed on the top side and extends along a portion of each of the right and left sides and parallel to the rear side. A lower zipper is disposed on the bottom side proximal the rear side and extends along a portion of each of the right side and the left side in a position parallel to the rear side. A lower compartment is disposed within the backpack portion continuously between the right and left sides, the bottom and top sides, and between the front side and the upper zipper. An upper compartment is disposed within the backpack portion continuously disposed between the rear side and the lower compartment. The lower and upper compartments are accessible through the lower and upper zippers, respectively.

A foldable sleeping mat is extendible from the lower compartment through the lower zipper. The sleeping mat has a first end disposed within the lower compartment and attached to the top side to prevent separation of the sleeping mat from the backpack portion and loss of the sleeping mat. The sleeping mat includes a plurality of cushions conjoined in a longitudinal configuration and a folding crease disposed between each of the cushions. A pair of adjustable carrying straps is attached to the front side of the backpack portion. Adjusting buckles on the carrying straps permit adjustment of a length of the carrying strap in order to secure the backpack portion onto a wearer's back. A cushioned auxiliary member is disposed on the outer wall in a position between the top side and the rear side. A pillow is disposed in the upper compartment; however, other items such as a pajama set, a toothbrush, an extra blanket, or other overnight necessities can also be stored in the upper compartment. Thus, the present device serves to carry all overnight items and sleeping mat together in a hands-free manner, and prevents a child from sleeping directly on the floor.

The rear side of the backpack portion is configured to resemble a body of an animal figure, while the auxiliary member is configured to resemble a head of the animal figure to encourage use by a child. The animal figure can be a lady bug as depicted or other animal figure. The device is provided in a range of sizes from small, to medium, large, and extra large to serve a wide age range of children; however, the device can also be provided to serve adults as well. In addition, the device is washable and light weight.

Thus has been broadly outlined the more important features of the present backpack with a pillow and extendible sleeping mat so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
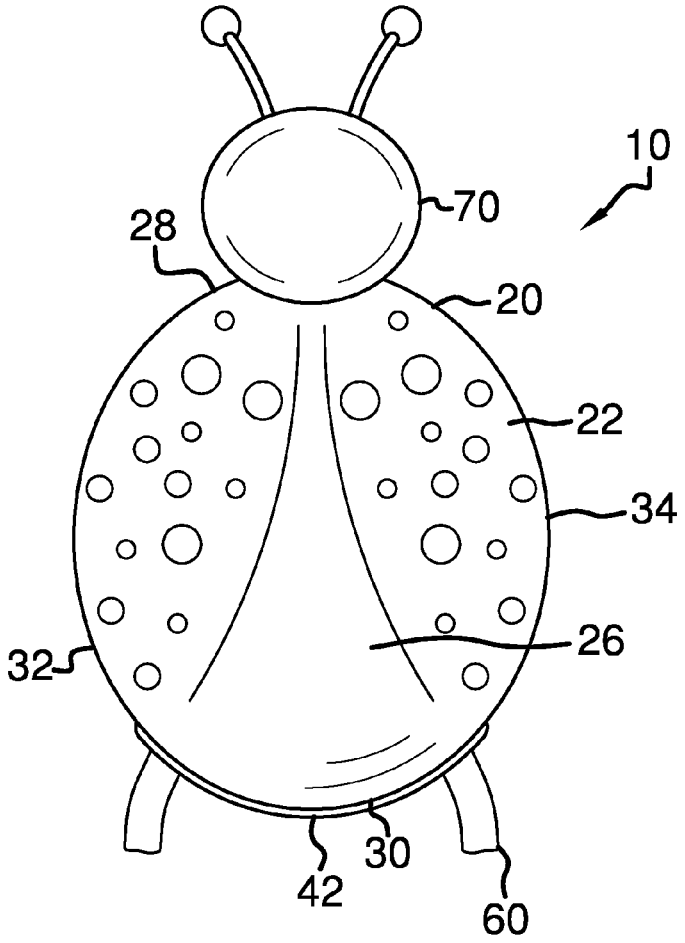
FIG. 1 is a rear elevation view.
Figure 2:
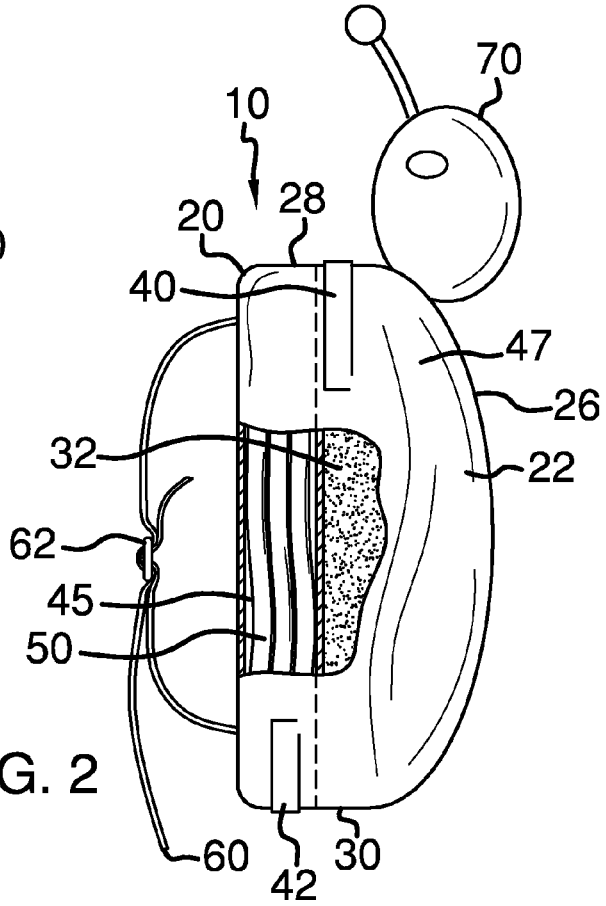
FIG. 2 is a side elevation view.
Figure 3:
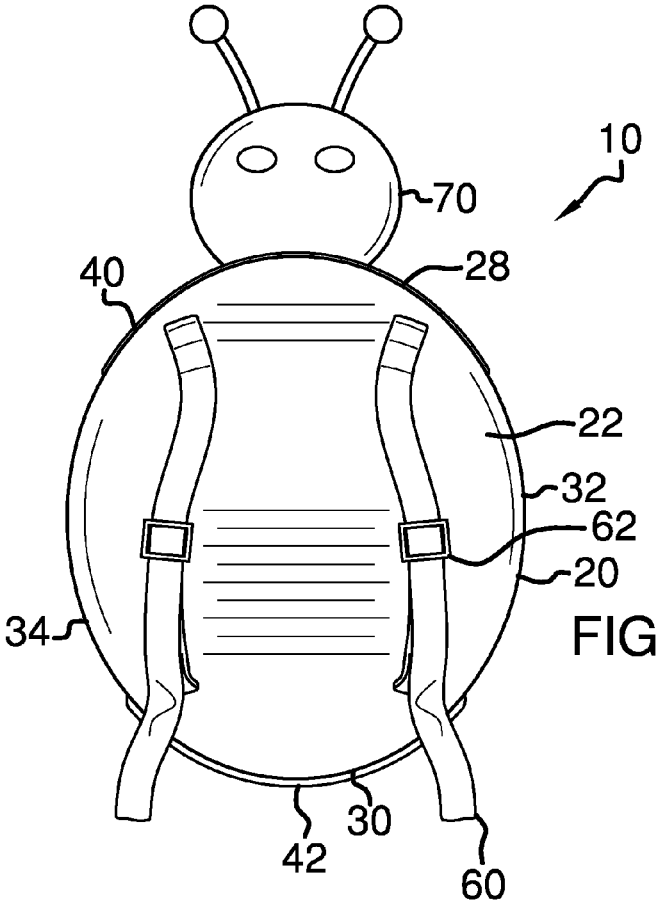
FIG. 3 is a front elevation view.
Figure 4:
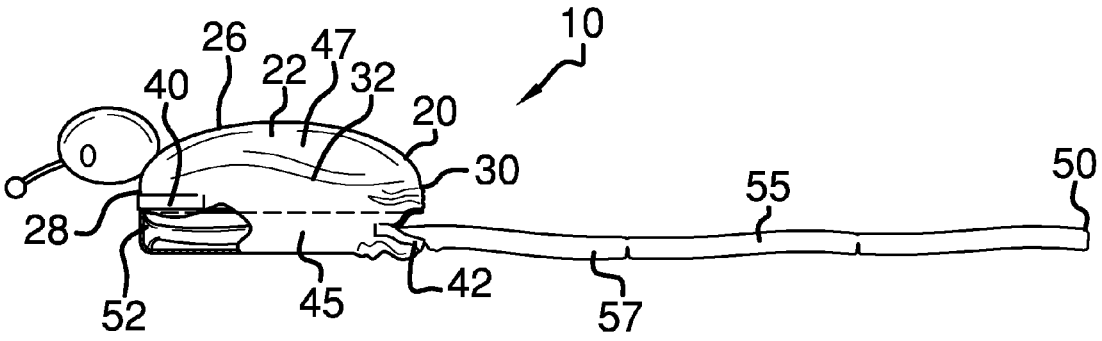
FIG. 4 is a side elevation showing a bottom end of the backpack in an open position and a sleeping mat in an extended position.
Figure 5:
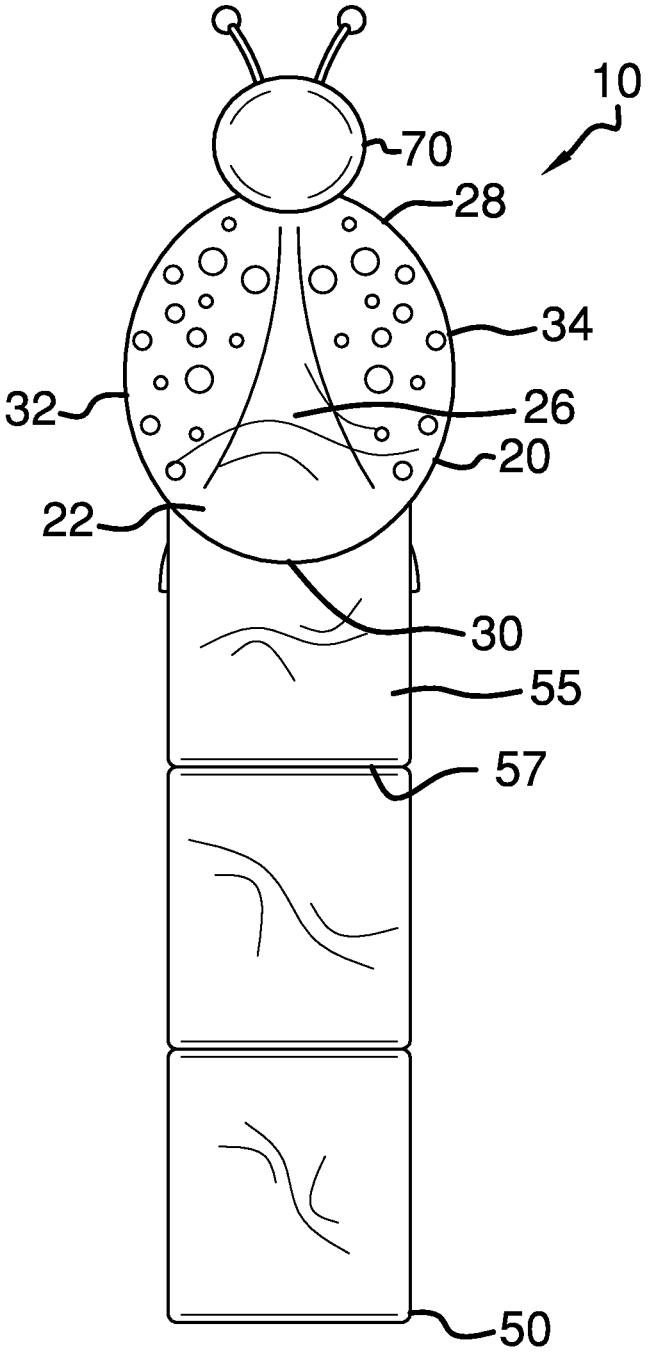
FIG. 5 is a top plan view.

With reference now to the drawings, and in particular FIGS. 1 through 6 thereof, an example of the instant backpack with a pillow and extendible sleeping mat employing the principles and concepts of the present backpack with a pillow and extendible sleeping mat and generally designated by the reference number 10 will be described.

Referring to FIGS. 1 through 5, the present backpack with a pillow and extendible sleeping mat 10 is illustrated. The backpack with a pillow and extendible sleeping mat 10 includes an expandable backpack portion 20 having a continuous outer wall 22. The outer wall 22 has a front side 24, a flat rear side 26, a top side 28, a bottom side 30, a right side 32, and a left side 34. An upper zipper 40 is centrally disposed on the top side 28 and extends along a portion of each of the right side 32 and the left side 34 in a position parallel to the rear side 26. A lower zipper 42 is disposed on the bottom side 30 proximal the rear side 26 and extends along a portion of each of the right side 32 and the left side 34 in a position parallel to the rear side 26.

A lower compartment 45 is disposed within the backpack portion 20 and is continuously disposed between the right side 32, the left side 34, the bottom side 30 and the top side 28 and between the front side 24 and the upper zipper 40. The lower compartment 45 is accessible through the lower zipper 42. An upper compartment 47 is disposed within the backpack portion 20 and is continuously disposed between the rear side 26 and the lower compartment 45. The upper compartment 47 is accessible through the upper zipper 40.

A foldable sleeping mat 50 is extendible from the lower compartment 45 through the lower zipper 42. The sleeping mat 50 has a first end 52 disposed within the lower compartment 45. The first end 52 is attached to the top side 28. The sleeping mat 50 includes a plurality of cushions 55 conjoined in a longitudinal configuration and a folding crease 57 disposed between each of the cushions 55. The attachment of the sleeping mat 50 to the backpack portion 20 assists in the prevention of separation and loss of the sleeping mat 50, particularly with use by a child.

A pair of adjustable carrying straps 60 is attached to the front side 24 of the backpack portion 20. Each of the carrying straps 60 has an adjusting buckle 62, which is configured to adjust a length of the carrying strap 60 in order to secure the backpack portion 20 onto a wearer's back.

A cushioned auxiliary member 70 is disposed on the outer wall 22 in a position between the top side 28 and the rear side 26. A pillow 72 is disposed in the upper compartment 47.

At least the rear side 26 of the backpack portion 20 is configured to resemble a body of an animal figure, while the auxiliary member 70 is configured to resemble a head of the animal figure to encourage use by a child. The animal figure can be a lady bug as depicted or other animal figure.

What is claimed is:

1. A backpack with a pillow and extendible sleeping mat comprising:

an expandable backpack portion having a continuous outer wall, the outer wall having a front side, a flat rear side, a top side, a bottom side, a right side, and a left side;

an upper zipper centrally disposed on the top side and extending along a portion of each of the right side and the left side in a position parallel to the rear side;

a lower zipper disposed on the bottom side proximal the rear side and extending along a portion of each of the right side and the left side in a position parallel to the rear side;

a lower compartment disposed within the backpack portion, the lower compartment continuously disposed between the right side, the left side, the bottom side and the top side and between the front side and the upper zipper, the lower compartment accessible through the lower zipper;

an upper compartment disposed within the backpack portion, the upper compartment continuously disposed between the rear side and the lower compartment, the upper compartment accessible through the upper zipper;

a foldable sleeping mat extendible from the lower compartment through the lower zipper, the sleeping mat having a first end disposed within the lower compartment, the first end attached to the top side, the sleeping mat formed of a plurality of cushions; and a pair of adjustable carrying straps attached to the front side of the backpack portion, each of the carrying straps having an adjusting buckle, the adjusting buckle configured to adjust a length of the carrying strap in order to secure the backpack portion onto a wearer's back.

2. A backpack with a pillow and extendible sleeping mat comprising:

an expandable backpack portion having a continuous outer wall, the outer wall having a front side, a flat rear side, a top side, a bottom side, a right side, and a left side;

an upper zipper centrally disposed on the top side and extending along a portion of each of the right side and the left side in a position parallel to the rear side;

a lower zipper disposed on the bottom side proximal the rear side and extending along a portion of each of the right side and the left side in a position parallel to the rear side;

a lower compartment disposed within the backpack portion, the lower compartment continuously disposed between the right side, the left side, the bottom side and the top side and between the front side and the upper zipper, the lower compartment accessible through the lower zipper;

an upper compartment disposed within the backpack portion, the upper compartment continuously disposed between the rear side and the lower compartment, the upper compartment accessible through the upper zipper;

a foldable sleeping mat extendible from the lower compartment through the lower zipper, the foldable sleeping mat having a first end disposed within the lower compartment, the first end attached to the top side, the sleeping mat comprising:

a plurality of cushions conjoined in a longitudinal configuration;

a folding crease disposed between each of the cushions;

a pair of adjustable carrying straps attached to the front side of the backpack portion, each of the carrying straps having an adjusting buckle, the adjusting buckle configured to adjust a length of the carrying strap in order to secure the backpack portion onto a wearer's back; and a cushioned auxiliary member disposed on the outer wall in a position between the top side and the rear side.

3. The backpack with a pillow and extendible sleeping mat of claim 2 wherein at least the rear side of the backpack portion is configured to resemble a body of an animal figure; and wherein the auxiliary member is configured to resemble a head of the animal figure.

4. The backpack with a pillow and extendible sleeping mat of claim 2 wherein the pillow is disposed in the upper compartment.

5. The backpack with a pillow and extendible sleeping mat of claim 3 wherein the pillow is disposed in the upper compartment.

6. The backpack with a pillow and extendible sleeping mat of claim 3 wherein the animal figure is a lady bug.

7. The backpack with a pillow and extendible sleeping mat of claim 5 wherein the animal figure is a lady bug.

8. A backpack with a pillow and extendible sleeping mat comprising:

an expandable backpack portion having a continuous outer wall, the outer wall having a front side, a flat rear side, a top side, a bottom side, a right side, and a left side;

an upper zipper centrally disposed on the top side and extending along a portion of each of the right side and the left side in a position parallel to the rear side;

a lower zipper disposed on the bottom side proximal the rear side and extending along a portion of each of the right side and the left side in a position parallel to the rear side;

a lower compartment disposed within the backpack portion, the lower compartment continuously disposed between the right side, the left side, the bottom side and the top side and between the front side and the upper zipper, the lower compartment accessible through the lower zipper;

an upper compartment disposed within the backpack portion, the upper compartment continuously disposed between the rear side and the lower compartment, the upper compartment accessible through the upper zipper;

a foldable sleeping mat extendible from the lower compartment through the lower zipper, the foldable sleeping mat having a first end disposed within the lower compartment, the first end attached to the top side, the sleeping mat comprising:

a plurality of cushions conjoined in a longitudinal configuration;

a folding crease disposed between each of the cushions;

a pair of adjustable carrying straps attached to the front side of the backpack portion, each of the carrying straps having an adjusting buckle, the adjusting buckle configured to adjust a length of the carrying strap in order to secure the backpack portion onto a wearer's back;

a cushioned auxiliary member disposed on the outer wall in a position between the top side and the rear side; and a pillow disposed in the upper compartment;

wherein at least the rear side of the backpack portion is configured to resemble a body of an animal figure; and wherein the auxiliary member is configured to resemble a head of the animal figure.

9. The backpack with a pillow and extendible sleeping mat of claim 8 wherein the animal figure is a lady bug.

* * * * *